US009245519B2

(12) United States Patent
Klug et al.

(10) Patent No.: US 9,245,519 B2
(45) Date of Patent: Jan. 26, 2016

(54) FORWARD SPEAKER NOISE CANCELLATION IN A VEHICLE

(71) Applicant: Bose Corporation, Framingham, MA (US)

(72) Inventors: Dennis Klug, West Bloomfield, MI (US); James May, Milford, MI (US); Davis Pan, Arlington, MA (US)

(73) Assignee: BOSE CORPORATION, Framingham, MA (US)

( * ) Notice: Subject to any disclaimer, the term of this patent is extended or adjusted under 35 U.S.C. 154(b) by 273 days.

(21) Appl. No.: 13/768,249

(22) Filed: Feb. 15, 2013

(65) Prior Publication Data

US 2014/0233748 A1 Aug. 21, 2014

(51) Int. Cl.
*G10K 11/16* (2006.01)
*G10K 11/178* (2006.01)

(52) U.S. Cl.
CPC ..... *G10K 11/178* (2013.01); *G10K 2210/1282* (2013.01)

(58) Field of Classification Search
None
See application file for complete search history.

(56) References Cited

U.S. PATENT DOCUMENTS

| | | | | |
|---|---|---|---|---|
| 5,493,616 | A | 2/1996 | Iidaka et al. | |
| 7,536,018 | B2 | 5/2009 | Onishi et al. | |
| 2001/0036279 | A1 | 11/2001 | Daly | |
| 2008/0144849 | A1* | 6/2008 | Abe et al. | 381/71.4 |
| 2008/0144850 | A1* | 6/2008 | Abe et al. | 381/71.4 |
| 2009/0067638 | A1* | 3/2009 | Sakamoto et al. | 381/71.4 |
| 2010/0124336 | A1* | 5/2010 | Shridhar et al. | 381/71.4 |
| 2010/0124337 | A1* | 5/2010 | Wertz et al. | 381/71.11 |
| 2011/0123042 | A1* | 5/2011 | Sakamoto et al. | 381/94.1 |
| 2012/0070013 | A1* | 3/2012 | Vau | 381/71.4 |
| 2012/0189132 | A1* | 7/2012 | Sakamoto et al. | 381/71.4 |
| 2012/0230504 | A1* | 9/2012 | Kuroda | 381/71.4 |
| 2012/0288110 | A1* | 11/2012 | Cherkassky et al. | 381/71.4 |
| 2012/0300955 | A1* | 11/2012 | Iseki et al. | 381/71.4 |
| 2013/0315409 | A1* | 11/2013 | Inoue et al. | 381/71.1 |
| 2014/0226831 | A1* | 8/2014 | Tzirkel-Hancock et al. | 381/71.7 |

FOREIGN PATENT DOCUMENTS

| | | |
|---|---|---|
| EP | 0539939 | 5/1993 |
| WO | 0165540 A1 | 9/2001 |

OTHER PUBLICATIONS

International Search Report and Written Opinion for International Application No. PCT/US2014/013870 mailed Apr. 15, 2014, 8 pages.

* cited by examiner

*Primary Examiner* — Brenda Bernardi
(74) *Attorney, Agent, or Firm* — Toler Law Group, PC

(57) ABSTRACT

Systems and methods to cancel noise in a vehicle are disclosed. A first speaker is positioned forward of a steering wheel of a vehicle. The first speaker generates a first signal configured to acoustically cancel noise produced by operation of the vehicle. A second speaker is positioned forward of the steering wheel. The second speaker generates a second signal to acoustically cancel the noise produced by the operation of the vehicle. The first and the second speakers are capable of generating the first and the second signals independently of one another.

20 Claims, 3 Drawing Sheets

FORWARD SPEAKER NOISE CANCELLATION IN A VEHICLE

I. FIELD OF THE DISCLOSURE

The disclosure relates to noise cancellation, and more particularly, to the reduction of engine and other undesirable noise within a passenger cabin of an automobile.

II. BACKGROUND

Automotive vehicles are designed for efficiency and high performance. The engines and transmissions that provide acceleration and handling can generate undesirable sounds that diminish the driving experience. For example, an engine can produce a high frequency noise that cannot be easily quieted by traditional noise countermeasures. The high frequency noise tones vary with the revolutions per minute (rpm) of the engine and affect passengers differently depending upon their chair positions, height, and posture within the vehicle.

III. SUMMARY OF THE DISCLOSURE

In a particular embodiment, an apparatus includes a first speaker positioned forward of a steering wheel of a vehicle. The first speaker generates a first signal configured to acoustically cancel noise produced by operation of the vehicle. A second speaker is positioned forward of the steering wheel. The second speaker generates a second signal to acoustically cancel the noise produced by the operation of the vehicle.

In another embodiment, an apparatus includes a speaker positioned forward of a steering wheel of a vehicle. The speaker is configured, in response to a control signal, to generate a noise cancelling signal to acoustically cancel noise produced by operation of the vehicle. The apparatus further includes a plurality of microphones. Each of the plurality of microphones are configured to convert sensed sound into one of a plurality of input signals. A controller in communication with the speaker and the plurality of microphones is configured to receive the plurality of input signals. The controller executes an active noise cancellation algorithm to generate the control signal.

In another embodiment, a method of cancelling noise in a vehicle includes positioning a first speaker forward of a steering wheel of a vehicle. The first speaker generates a first signal to acoustically cancel noise produced by operation of the vehicle. A second speaker is positioned forward of the steering wheel. The second speaker generates a second signal to acoustically cancel the noise produced by the operation of the vehicle.

Positioning speakers forward within a vehicle facilitates independent and localized control of noise cancellation processes. When used in combination with aft positioned speakers and sensor microphones, the forward positioned speakers provide control to cancel sinusoidal noise up to and beyond 180 hertz (Hz) in a spatial area large enough to accommodate passengers having different heights, chair positions, and postures. Because each speaker controller receives input from multiple microphones, relatively few microphones may be used to produce a desired acoustic result. Embodiments of the active noise cancellation system create a large noise cancellation zone. For example, the noise cancellation zone in a vehicle spans four seats with a wide buffer of silence around each seat. A large cancellation zone minimizes spatial challenges and noise variance conventionally attributable to passengers having different heights and postures. Embodiments of the active sound management system further reduce the reliance on other noise countermeasures, enabling manufacturers to produce vehicles that are lighter and more efficient with improved sound and performance characteristics, contributing to a better driving experience.

These and other advantages and features that characterize embodiments are set forth in the claims annexed hereto and forming a further part hereof. However, for a better understanding of the invention, and of the advantages and objectives attained through its use, reference should be made to the Drawings and to the accompanying descriptive matter in which there are described exemplary embodiments.

IV. BRIEF DESCRIPTION OF THE DRAWINGS

V. DETAILED DESCRIPTION

An embodiment of an active sound management system includes noise cancellation capable speakers positioned forward of a steering wheel, such as within an instrument panel of a vehicle. The forward speaker placement increases the range of frequency of the noise that can be cancelled over a sufficiently large spatial area. Controllers for the speakers operate within the sound system of the vehicle and continuously receive information relating to engine noise. At the same time, each speaker controller concurrently receives inputs from multiple microphones in the vehicle cabin. The wave characteristics of the targeted engine noise are determined. Acoustically opposite signals are independently generated by each speaker to cancel the detected sound, reducing unwanted engine noise in the cabin. The active sound management system operates continuously and automatically.

Positioning speakers on top of the instrument panel provides independent and localized control of noise cancellation processes. The forward positioned speakers may be driven by a controller using an adaptive, active sound management algorithm that allows for the independent control of individual speakers or groups of speakers. When used in combination with aft positioned speakers and sensor microphones, the forward positioned speakers of an embodiment provide enough control to cancel sinusoidal harmonic frequency noise greater than 180 Hz over a large spatial area. The forward positioned speakers provide an extra degree of freedom for cancelling unwanted noise. The forward positioned speakers complement other speakers, positioned aft of the steering wheel, by contributing to noise cancellation of the entire group of speakers. Embodiments of the active noise cancellation system thus achieve upper frequency range noise cancellation.

A particular embodiment of the active noise cancellation system creates a large noise cancellation zone. For example, an illustrative noise cancellation zone spans four seats with a wide buffer of silence around each seat. Speakers are installed on the center, left, and right-hand sides of a top surface of an instrument panel of the vehicle to cancel high frequency noise (e.g., including and beyond 180 Hz) simultaneously in an area spanning all four seats.

Embodiments of the active sound management system reduce the reliance on other noise countermeasures, enabling manufacturers to produce vehicles that are lighter and more efficient with improved sound and performance characteristics, contributing to a better driving experience.

Figure 1:
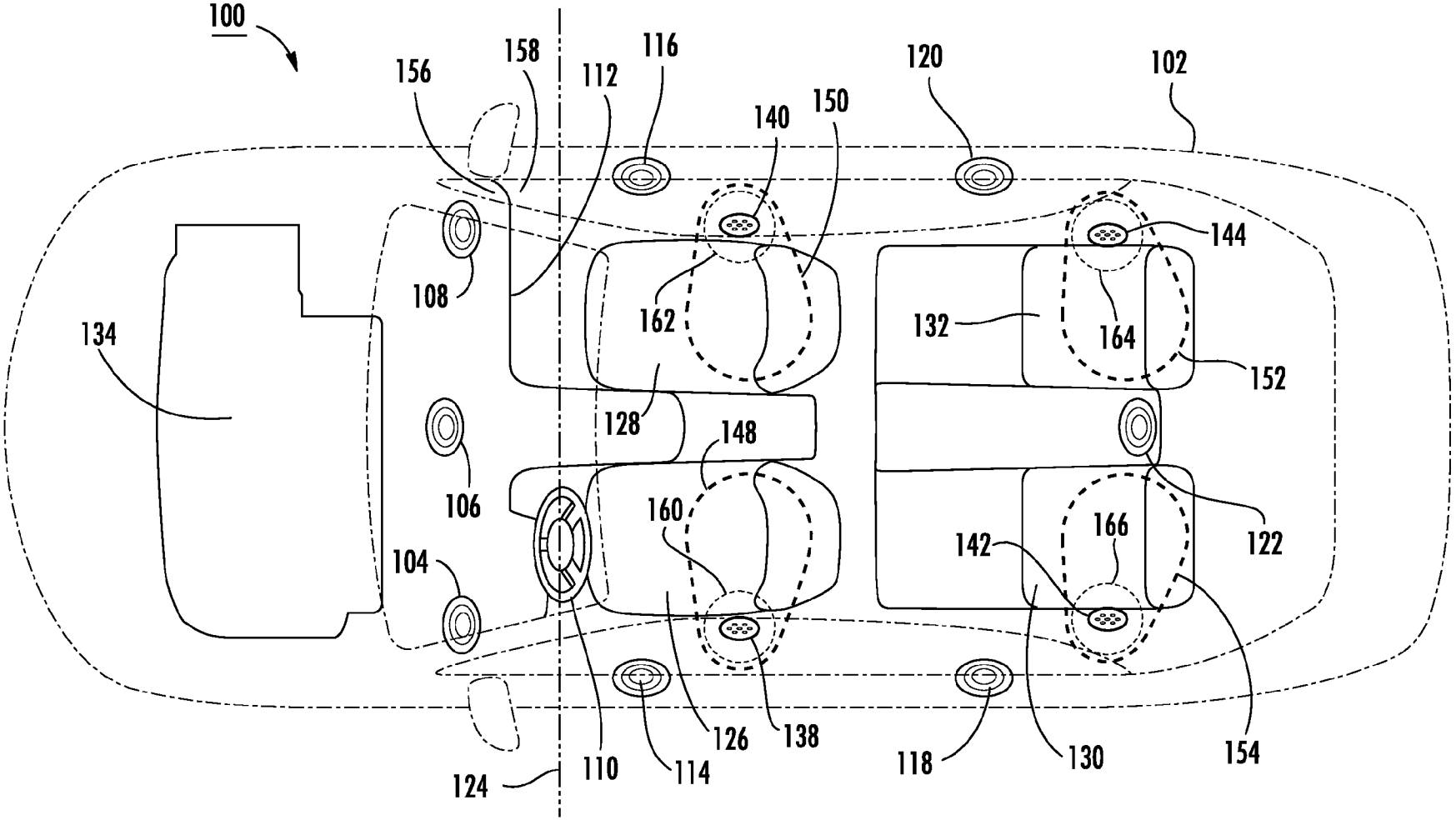
FIG. 1 is a top, cross-sectional view of an embodiment of an active sound management system having low frequency capable speakers positioned forward of a steering wheel of an automobile.

FIG. 1 is a top, cross-sectional view of an embodiment of an active sound management system 100 having speakers 104, 106, 108 positioned forward of a steering wheel 110. The forward speakers 104, 106, 108 include low frequency, or bass-capable speakers, and generate respective noise cancelling signals configured to acoustically cancel noise produced by operation of an automobile 102.

As shown in FIG. 1, the first speaker 104 is positioned at a driver's side, top portion of an instrument panel 112. The second speaker 106 is positioned at a center, top portion of the instrument panel 112. The third speaker 108 is positioned at a passenger's side, top portion of the instrument panel 112. The active sound management system 100 additionally includes speakers 114, 116, 118, 120, 122 positioned aft of the steering wheel 110, as designated by dashed line 124. The speakers 114, 116 are located adjacent front seats 126, 128, and speakers 118, 120 are positioned adjacent rear seats 130, 132. A rear speaker 122 is positioned at the rear of the automobile 102. The speakers 114, 116, 118, 120, 122 generate noise cancelling signals configured to acoustically cancel noise produced by operation of the automobile 102. Such automobile noise is produced by the engine and/or transmission 134 of the automobile 102. The noise cancelling signals of an embodiment are configured to acoustically cancel sinusoidal frequency noise up to and beyond 180 Hz in a large spatial area.

The speakers 104, 106, 108, 114, 116, 118, 120, 122 each receive inputs from multiple microphones 138, 140, 142, 144 distributed inside the cabin of the automobile 102. For example, the microphones 138, 140, 142, 144 of FIG. 1 are positioned on a headliner near the seats 126, 128, 130, 132. Positioning of the microphones 138, 140, 142, 144 near the headliner facilitates the determination of changing high and low frequency levels and their associated patterns. The microphones 138, 140, 142, 144 continuously monitor and convert sound into input signals that are provided to one or more controllers in communication with each speaker 104, 106, 108, 114, 116, 118, 120, 122. The inputs are used by an active sound management algorithm to make adjustments to the noise cancellation signals. While four microphones 138, 140, 142, 144 are shown in FIG. 1 as being in communication with the controllers for each speaker 104, 106, 108, 114, 116, 118, 120, 122, other embodiments include inputs from more or fewer microphones and speakers.

The active sound management system 100 generates large noise cancellation zones 148, 150, 152, 154 associated with each seat 126, 128, 130, 132. The noise cancellation zones 148, 150, 152, 154 are relatively larger than smaller noise cancellation zones 160, 162, 164, 166 generated close to the microphones 138, 140, 142, 144. The noise cancellation zones 148, 150, 152, 154 reduce spatial challenges and noise variance conventionally attributable to passengers having different heights, chair positions, and postures. For example, the noise cancellation zones 148, 150, 152, 154 may each have a spatial dimension (e.g., a height, a width, and/or a length) larger than seven and one half inches in which a noise cancelling frequency of greater than 180 Hz is present. At 180 Hz, for instance, the area of the noise cancelation may have a dimension that is longer than one tenth of a wavelength. At another frequency, a noise cancellation zone having an illustrative spatial dimension of larger than a foot may be achieved.

While the forward speakers 104, 106, 108 are shown in FIG. 1 as being positioned on top of the instrument panel 112, forward speakers of another embodiment may additionally or alternatively include speakers in other positions forward to the steering wheel 110, such as in a dashboard, in a kick panel, in a floorboard, at an A-pillar location 156, or at a shark-fin location 158.

FIG. 1 thus shows an active sound management system 100 that reduces unwanted cabin noise in an automobile. At least two speakers 104, 106, 108 are positioned in a forward portion of the cabin to create relatively large noise cancellation zones 148, 150, 152, 154 that accommodate passenger movement within the cabin and that account for passengers of different heights. The noise cancellation zones 148, 150, 152, 154 reduce spatial challenges and noise variance conventionally attributable to passengers having different heights and postures. The speakers 104, 106, 108 may function as part of a sound system capable of producing desired audio, while additionally generating the noise cancelling signals. Independent operation of the forward speakers 104, 106, 108 complements the noise cancelling operations of other speakers 114, 116, 118, 120, 122 in the active sound management system 100 to continuously monitor and cancel even high frequency noise.

Figure 2:
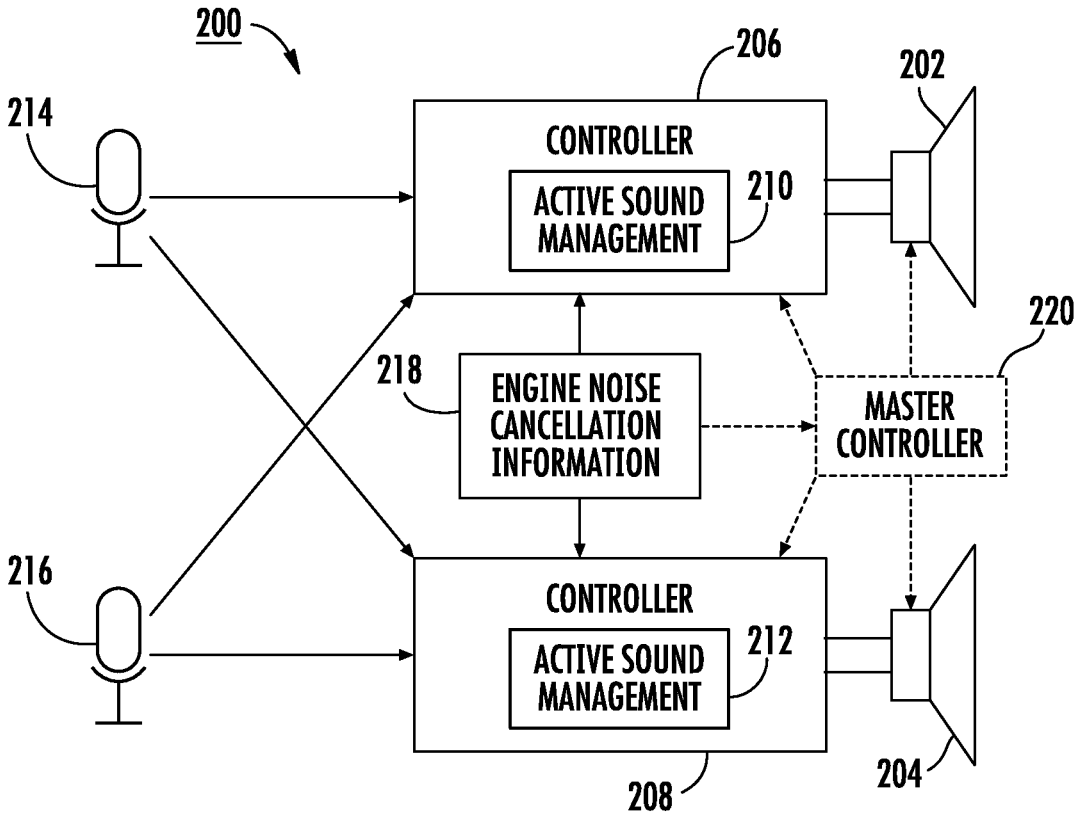
FIG. 2 is a block diagram of an embodiment of an active sound management system having multiple speakers, each driven by controllers configured to receive multiple inputs from multiple microphones.

FIG. 2 shows block diagram of an embodiment of an active sound management system 200 having multiple speakers 202, 204 each driven by controllers configured to receive multiple inputs from multiple microphones 214, 216. The active sound management system 200 may be similar to the active sound management system 100 of FIG. 1. First and second speakers 202, 204 may be similar to the forward speakers 104, 106 of FIG. 1. For instance, the first and the second speakers 202, 204 may include low frequency, or bass-capable speakers. Illustrative low frequency speakers have an output of less than 180 Hz.

According to a particular embodiment, the first and the second speakers 202, 204 operate independently to generate respective noise cancelling signals. Accordingly, each speaker 202, 204 is driven by a first and a second controller 206, 208, respectively. More particularly, the first controller 206 executes an active sound management algorithm 210 to generate a first noise cancelling signal at the first speaker 202. The second controller 208 executes an active sound management algorithm 212 to generate a second noise cancelling signal at the second speaker 212.

The first and the second controllers 206, 208 each receive inputs from the first and the second microphones 214, 216. The first and the second microphones 214, 216 are similar to the microphones 138, 140, 142, 144 of FIG. 1. While the first and the second microphones 214, 216 are shown in FIG. 2 as being in communication with the first and the second controllers 206, 208, other embodiments include inputs from more or fewer than two microphones. The first and the second microphones 214, 216 may be positioned near the headliner of an automobile assist in determining changing frequency levels and patterns. The first and the second controllers 206, 208 (and the first and the second speakers 202, 204) additionally receive engine noise cancellation information 218 from the engine and/or transmission of the automobile. The engine noise cancellation information 218 is relayed to the controllers 206, 208 via a sensor monitoring a performance characteristic of the engine, such as revolutions per minute (rpm) or a decibel level. The engine noise cancellation information 218 of FIG. 2 is sensed separately from that of the first and the second microphones 214, 216. However, another embodiment uses microphones to sense engine noise without information being directly transmitted from a sensor monitoring the engine operation.

Enabling each speaker to operate as an independent noise cancelling mechanism allows high frequency sinusoidal frequencies to be cancelled. The controller of each speaker processes input signals from all of the microphones 214, 216. Receiving inputs from all of the microphones 214, 216 enables multiple input signals to be weighted and processed in together. Alternatively, according to a particular embodiment, the first and the second speakers 202, 204 are at times operated in conjunction with one another, e.g., driven in mono. For instance, conditions could exist where it is beneficial to reduce the degrees of freedom, such as where there are too many potential solutions that could use large amounts of power with relatively little noise cancellation. An illustrative condition is where the outputs from speakers 202, 204 are automatically determined to be working against each other, e.g., cancelling one another out. In such a circumstance, operation of the speakers is reconfigured to operate in a paired, non-autonomous mode (automatic reconfiguration is a current research topic and should not be disclosed).

According to a particular embodiment, the first and the second speakers 202, 204 are alternatively or additionally controlled using a master controller 220. Where the first and the second controllers 206, 208 are present, the master controller 220 modifies or tunes output wavelength characteristics, or otherwise coordinates signal calculations made by the first and the second controllers 206, 208. For example, the master controller 220 may act to turn all the speakers off under certain pre-defined conditions, such as when a door is opened. The master controller 220 reacts automatically to sensed sound data, and additionally or alternatively uses empirical results gleaned from testing in an automotive environment.

FIG. 2 thus shows an apparatus that includes a plurality of speakers 202, 204, each driven by controllers configured to receive input signals from multiple microphones 214, 216. Because each speaker controller receives input from multiple microphones (as opposed to each speaker controller or speaker controller pair receiving inputs from a single microphone), fewer microphones are used to produce a desired acoustic result. When used in combination with the aft positioned speakers and the sensor microphones, the forward positioned speakers provide control to cancel sinusoidal noise up to and beyond 180 Hz in a relatively large spatial area.

Figure 3:
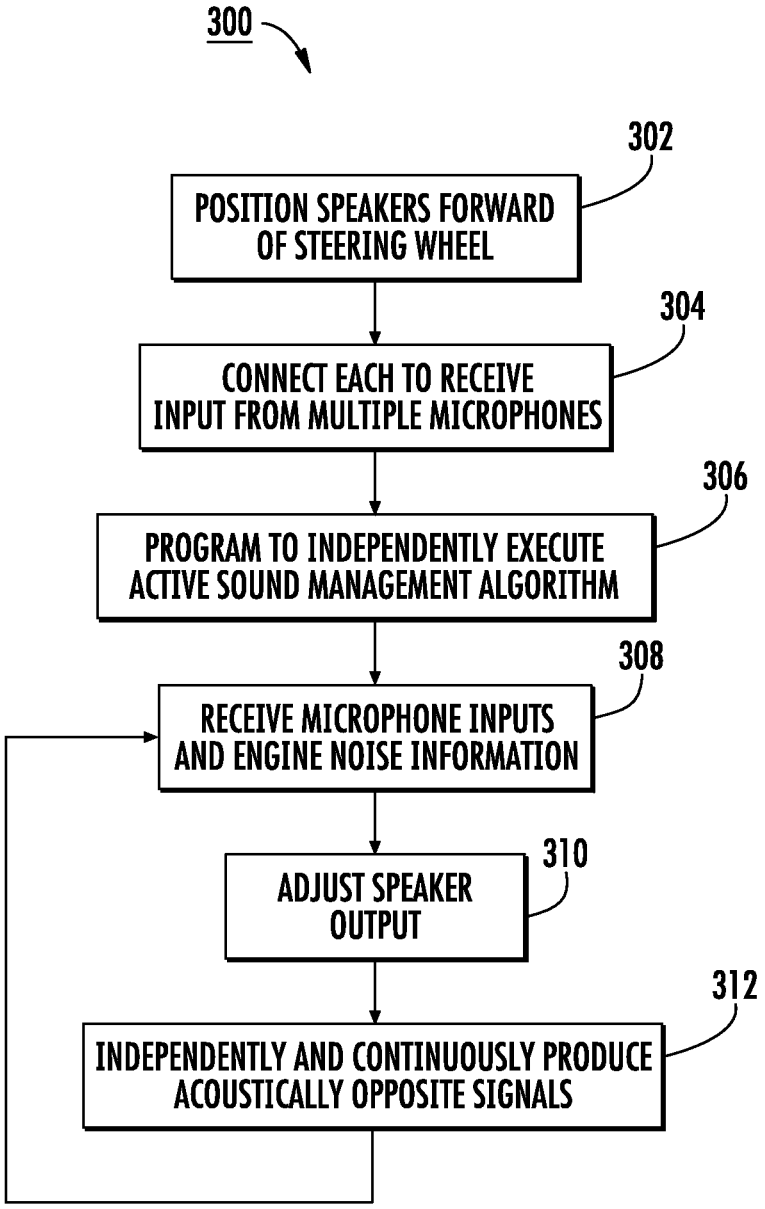
FIG. 3 is a flowchart of an embodiment of a method of cancelling sinusoidal high frequency noise in an automobile cabin using forward positioned speakers.

FIG. 3 is a flowchart 300 of an embodiment of a method of cancelling sinusoidal noise in an automobile cabin using forward positioned speakers. The method is executed by the illustrative active sound management system 100 of FIG. 1. Turning more particularly to the flowchart 300, speakers are positioned forward of a steering wheel, at 302. For example, the first, second, and third speakers 104, 106, 108 of FIG. 1 are installed forward of the dashed line 124, relative to the steering wheel 110.

At 304, the speakers are connected to controllers that receive input signals from multiple sound sensing microphones. As shown in FIG. 1, the first, second, and third speakers 104, 106, 108 each have controllers which receive inputs from two, three, or all of the microphones 138, 140, 142, 144. Similarly, the speakers 114, 116, 118, 120, 122 aft of the forward speakers 104, 106, 108 each have controllers that receive inputs from multiple microphones 138, 140, 142, 144.

The speaker controllers are programmed at 306 to independently execute the active sound management algorithm to cancel undesired noise within the automobile cabin. For instance, the active sound management algorithm is executed for each of the speakers 104, 106, 108, 114, 116, 118, 120, 122 of FIG. 1. The independent execution of the active sound management algorithm facilitates added degrees of freedom in achieving noise cancellation at different spatial zones in the cabin when the level of noise is different in each zone.

The speaker controllers receive microphone and engine noise information at 308. In FIG. 1, the speakers 104, 106, 108, 114, 116, 118, 120, 122 have controllers that receive inputs from the microphones 138, 140, 142, 144. The speaker controllers additionally receive inputs from other areas of the vehicle, including information associated with noise originating from the engine or the transmission.

At 310, the speaker controllers are programmed or otherwise configured such that their output can be adjusted. While each speaker controller operates independently to cancel noise according to the active sound management algorithm, a particular embodiment may adjust one or more speakers based on the collective output of the speakers. The adjustment may include modifying the wave characteristics of the noise cancellation signals output from one or more of the speakers.

At 312, the speaker controllers independently and continuously produce noise cancelling signals. For example, the speakers 104, 106, 108, 114, 116, 118, 120, 122 of FIG. 1 generate noise cancelling signals that are acoustically the opposite of noise detected by the microphones 138, 140, 142, 144 and produced by the engine. The active sound management system loops back to 308 to continuously and automatically cancel noise.

FIG. 3 thus shows a method of noise cancellation that uses low frequency capable speakers positioned in the forward cabin of a vehicle. Positioning speakers on the instrument panel, for instance, provides independent and localized control of noise cancellation processes. Active sound management processes reduce the reliance on other noise countermeasures, enabling manufacturers to produce vehicles that are lighter and more efficient with improved sound and performance characteristics, contributing to a better driving experience.

Those skilled in the art may make numerous uses and modifications of and departures from the specific apparatus and techniques disclosed herein without departing from the inventive concepts. Consequently, the disclosed embodiments should be construed as embracing each and every novel feature and novel combination of features present in or possessed by the apparatus and techniques disclosed herein and limited only by the scope of the appended claims, and equivalents thereof.

The invention claimed is:

1. An apparatus, comprising:

a first speaker positioned forward of a steering wheel of a vehicle;

a second speaker positioned forward of the steering wheel, wherein the first speaker and the second speaker generate a plurality of noise cancellation signals to acoustically cancel noise produced by operation of the vehicle;

a first controller configured to execute active noise cancellation to affect operation of the first speaker;

a second controller configured to execute active noise cancellation to affect operation of the second speaker; and a master controller configured to adjust a signal calculation of at least one of the first controller and the second controller.

2. The apparatus of claim 1, wherein the first speaker and the second speaker are low frequency capable speakers.

3. The apparatus of claim 1, wherein at least one of the plurality of noise cancellation signals a frequency above 180 hertz in an area comprising a dimension larger than seven and one half inches in length.

4. The apparatus of claim 1, wherein the first controller receives engine noise cancellation information.

5. The apparatus of claim 1, wherein at least one of the first speaker and the second speaker are positioned in at least one of an instrument panel, a dashboard, a kick panel, a floorboard, a shark-fin location, and an A-pillar location.

6. The apparatus of claim 1, wherein the first speaker and the second speaker selectively operate in a non-autonomous mode.

7. The apparatus of claim 1, wherein the signal calculation is adjusted to modify an output wavelength characteristic.

8. The apparatus of claim 1, wherein the signal calculation is adjusted to coordinate calculations made by the first and the second controllers.

9. The apparatus of claim 1, wherein the master controller is configured to disable a function of the first controller in response to a pre-defined condition.

10. The apparatus of claim 1, further comprising a plurality of microphones configured to convert sensed sound into a plurality of signals, wherein the first controller receives a first signal from a first microphone of the plurality of microphones, and wherein the second controller receives a second signal from the first microphone.

11. The apparatus of claim 10, wherein the first and the second signals are generated independently of one another.

12. An apparatus, comprising:

a speaker positioned forward of a steering wheel of a vehicle, the speaker configured, in response to a control signal, to generate a noise cancelling signal to acoustically cancel noise produced by operation of the vehicle;

a plurality of microphones, each of the plurality of microphones configured to convert sensed sound into one of a plurality of signals; and a first controller in communication with the speaker and the plurality of microphones, the first controller configured to receive the plurality of signals and to execute active noise cancellation to generate the control signal; and a master controller configured to adjust a signal calculation of the first controller.

13. A method of cancelling noise in a vehicle, the method comprising:

positioning a first speaker forward of a steering wheel of a vehicle;

positioning a second speaker forward of the steering wheel, wherein the first speaker and the second speaker generate a plurality of noise cancellation signals to acoustically cancel noise produced by operation of the vehicle;

using a first controller to execute active noise cancellation to affect operation of the first speaker;

using a second controller to execute active noise cancellation to affect operation of the second speaker; and using a master controller to adjust a signal calculation of at least one of the first controller and the second controller.

14. The method of claim 13, further comprising generating the first and the second signals independently of one another.

15. The method of claim 13, wherein the first speaker and the second speaker are low frequency capable speakers.

16. The method of claim 13, further comprising executing active noise cancellation to affect operation of at least one of the first speaker and the second speaker.

17. The method of claim 13, further comprising receiving engine noise cancellation information.

18. The method of claim 13, wherein positioning the first speaker further comprises positioning the first speaker in at least one of an instrument panel, a dashboard, a kick panel, a floorboard, a shark-fin location, and an A-pillar location.

19. The method of claim 13, further comprising continuously adjusting the first signal and the second signal according to a sensed sound.

20. The apparatus of claim 1, wherein the first controller is configured to receive engine noise information from at least one of the plurality of microphones without receiving the engine noise information directly from a sensor monitoring engine operation.

* * * * *